US007431436B1

(12) United States Patent
Mills et al.

(10) Patent No.: US 7,431,436 B1
(45) Date of Patent: Oct. 7, 2008

(54) IDENTIFICATION SYSTEM FOR INKS IN PRINTING SYSTEMS

(75) Inventors: Michael D. Mills, Moultonborough, NH (US); Craig E. Carroll, Moultonborough, NH (US)

(73) Assignee: VUTEk, Incorporated, Meredith, NH (US)

( * ) Notice: Subject to any disclaimer, the term of this patent is extended or adjusted under 35 U.S.C. 154(b) by 99 days.

(21) Appl. No.: 10/706,870

(22) Filed: Nov. 12, 2003

Related U.S. Application Data

(60) Provisional application No. 60/425,840, filed on Nov. 12, 2002.

(51) Int. Cl.
*B41J 2/175* (2006.01)

(52) U.S. Cl. ..... 347/85; 347/86

(58) Field of Classification Search ..... 347/85, 347/19, 86

See application file for complete search history.

(56) References Cited

U.S. PATENT DOCUMENTS

| | | | | |
|---|---|---|---|---|
| 4,384,288 | A | 5/1983 | Walton | |
| 4,926,187 | A | 5/1990 | Sugawara et al. | |
| 5,444,223 | A | 8/1995 | Blama | |
| 5,574,470 | A | 11/1996 | de Vall | |
| 5,604,485 | A | 2/1997 | Lauro et al. | |
| 5,838,253 | A | 11/1998 | Wurz et al. | |
| 5,874,902 | A | 2/1999 | Heinrich et al. | |
| 5,914,862 | A | 6/1999 | Ferguson et al. | |
| 5,964,656 | A | 10/1999 | Lawler, Jr. et al. | |
| 5,986,569 | A | 11/1999 | Mish et al. | |
| 5,995,006 | A | 11/1999 | Walsh | |
| 6,019,461 | A * | 2/2000 | Yoshimura et al. | 347/86 |
| 6,043,746 | A | 3/2000 | Sorrells | |
| 6,078,259 | A | 6/2000 | Brady et al. | |
| 6,097,301 | A | 8/2000 | Tuttle | |
| 6,100,804 | A | 8/2000 | Brady et al. | |
| 6,100,840 | A | 8/2000 | Zidek et al. | |
| 6,104,281 | A | 8/2000 | Heinrich et al. | |
| 6,206,282 | B1 | 3/2001 | Hayes, Sr. et al. | |
| 6,218,942 | B1 | 4/2001 | Vega et al. | |
| 6,232,870 | B1 | 5/2001 | Garber et al. | |
| 6,265,977 | B1 | 7/2001 | Vega et al. | |
| 6,305,548 | B1 | 10/2001 | Sato et al. | |

(Continued)

FOREIGN PATENT DOCUMENTS

EP 1060895 A1 * 12/2000

OTHER PUBLICATIONS

RFID, Inc., Hardware Settings, STX reader, pp. 1-3.

(Continued)

*Primary Examiner*—Manish S. Shah
*Assistant Examiner*—Laura E Martin
(74) *Attorney, Agent, or Firm*—Michael A. Glenn; Glenn Patent Group

(57) ABSTRACT

A radio frequency (RF) identification system includes a tag for identifying characteristics of an ink, and a reader that receives transmitted RF signals from the tag. The tag includes a memory which stores data, and an RF source which generates RF signals. Selective data are transmitted as the RF signals, identifying characteristics of the ink, such as the color of the ink and the age of the ink. A disabler circuit can be used to shut down printing operations if the identified characteristics of the ink do not meet pre-determined criteria.

12 Claims, 5 Drawing Sheets

U.S. PATENT DOCUMENTS

| | | | | |
|---|---|---|---|---|
| 6,346,881 | B1 | 2/2002 | Davidson | |
| 6,361,138 | B1 * | 3/2002 | Seino et al. | 347/19 |
| 6,385,407 | B1 * | 5/2002 | Inose | 399/24 |
| 6,533,383 | B1 * | 3/2003 | Saruta et al. | 347/19 |
| 6,644,771 | B1 | 11/2003 | Silverbrook | |
| 6,808,255 | B1 * | 10/2004 | Haines et al. | 347/86 |
| 6,938,976 | B2 * | 9/2005 | Siwinski et al. | 347/19 |
| 2003/0043243 | A1 * | 3/2003 | Trafton et al. | 347/86 |

OTHER PUBLICATIONS

RFID, Inc., Installation and Operating Manual, Model SR1 and Model SR2, Simple Reader Writer, Version 3/00, pp. 1-10.

* cited by examiner

IDENTIFICATION SYSTEM FOR INKS IN PRINTING SYSTEMS

RELATED APPLICATION(S)

This application claims the benefit of U.S. Provisional Application No. 60/425,840, filed Nov. 12, 2002, the entire teachings of which are incorporated herein by reference.

BACKGROUND OF THE INVENTION

In certain large-scale printing systems, printheads are used to eject ink onto a substrate to create the desired image, for example, on substrates such as museum displays, billboards, sails, bus boards, and banners. In some of these printing systems, the printheads receive ink from an ink supply or reservoir and use a so-called "drop on demand" ink jet process. With this type of process, ink is ejected from one or more nozzles of the printheads only when a piezoelectric crystal in the printhead is actuated. In particular, the piezoelectric crystal creates a pulse in the ink so that the ink expels through the nozzle as a droplet. To create the image, a carriage which holds one or more printheads scans or traverses across the substrate while the printheads deposit ink as the substrate moves. In some other systems, the substrate moves underneath a stationary set of printheads as the printheads deposit ink.

Generally, the printheads are under the direction of a controller or CPU. Digital information related to the desired image is stored within the memory of the controller or CPU. A software application in the CPU instructs the printheads to deposit ink in a particular sequence based on the stored digital information to generate a predetermined image on the substrate. Some of these systems use different colored inks to create the desired images. For instance, black, yellow, cyan, and magenta colored inks are commonly employed alone or in combination to generate the image. Other systems use additional colored inks, such as light black, light yellow, light cyan, and light magenta to create images with higher resolution. In general, images created with a greater number of colored inks are typically of higher quality than those generated with fewer colored inks.

Regardless of the number of colored inks used to generate the images, each printhead receives ink of a particular color from a respective container or reservoir. Hence, the ink reservoir or container associated with each printhead must contain the colored ink identified with each printhead, otherwise the printhead will deposit the incorrect colored ink.

As ink in the various containers runs out, an operator has to replace the containers with a full supply of ink. This is done, for example, between printing operations. However, the operator may inadvertently connect a reservoir with the wrong colored ink to a respective printhead. This may occur, for example, when the operator is in a rush to complete a high volume operation. Or perhaps, the operator might think that a container holds a dark colored ink when it actually holds a light colored ink. Thus, in a subsequent printing operation, the controller or CPU may not know that a particular printhead is depositing a wrong colored ink on the substrate. Moreover, the problem may not be noticed and resolved until one or more images are generated. Since these images are generated with one or more incorrect colors, they are typically discarded, which increases the cost of the printing operation.

Other factors which may impact the cost of operating the printer include the use of ink that has exceeded its expiration date. Typically, the operator does not know how old the ink being used is. Generally, the operator keeps a log of when a particular ink container has been placed in the printer. Not infrequently, the operator may not refer to the log, and out of date ink may end up being used to the detriment of the printed image.

SUMMARY OF THE INVENTION

In view of the above discussion, it is desirable to identify certain characteristics of the ink contained in the ink reservoirs of printing systems. For example, ideally, there should be an economical and efficient way of identifying the color of the ink in each container, as well as the age of the ink, to ensure that the proper color ink is associated with the container, and that the ink is not being used past its expiration date.

In one aspect, the present invention implements a system to identify various characteristics of the ink contained in the primary ink reservoirs or containers. In particular, the system uses an electromagnetic or acoustic reader/writer that communicates with a tag associated with each ink container.

A tag, sometimes referred to as a transponder or label, is associated with each container. The tag includes a memory chip or device with logic which stores data related to the characteristics of the ink in its respective container. In a first embodiment, the data from a CPU is transmitted to the tag as a radio frequency (RF) signal. The tag includes an RF source which, in response to the CPU signal, generates an outgoing RF signal associated with output data stored in the tag memory.

A logic circuit in the tag may instruct the RF source in the tag to generate the output data taken from the tag memory as the outgoing RF signal. The output data may identify the color of the ink, and/or the age of the ink. In some embodiments, the system includes a reader/writer that sends data to and receives outgoing data from the tag. A controller may be coupled to the reader/writer, and a disabler circuit may be coupled to the controller or the CPU. The disabler circuit disables the printing system when the data from the tag indicates that a particular container holds an ink that is not the proper color or the ink has exceeded its expiration date.

A radio frequency (RF) identification tag for identifying characteristics of an ink may include a memory which stores data, and an RF source which generates RF signals. Selective data are transmitted as the RF signals, identifying the color of the ink and the age of the ink. A reader may receive the transmitted RF signals from the RF identification tag.

In certain embodiments, a radio frequency (RF) identification tag includes a memory which stores data, an RF source which generates RF signals, and a logic circuit which inputs the data into the memory from a central controller or CPU, and instructs the memory to output selective data to the controller. The selective data is transmitted as the RF signals, identifying the color of the ink and the age of the ink.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 1:
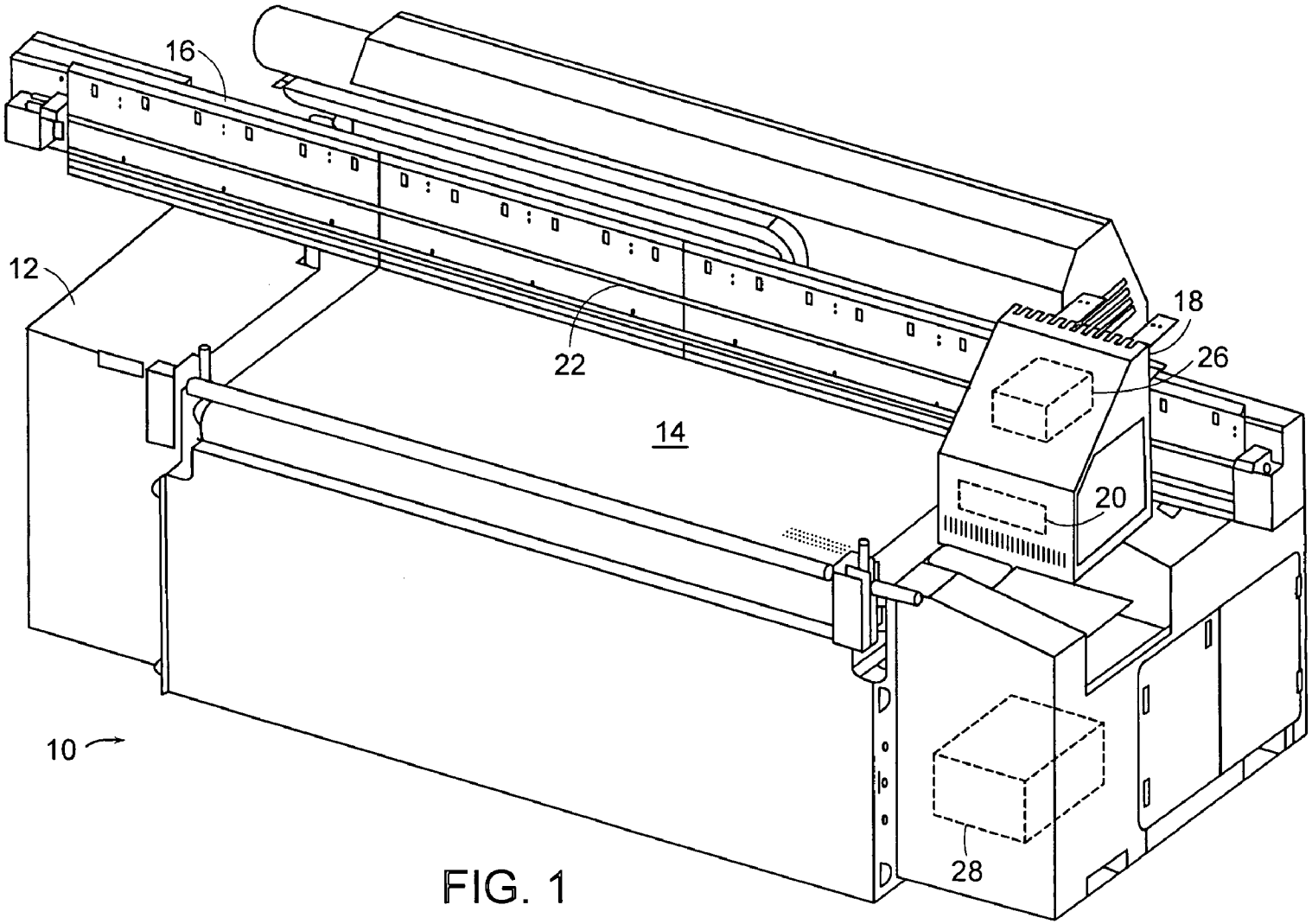
FIG. 1 is perspective view of a printing system.

Turning now to the drawings, there is shown in FIG. 1 a printing system, generally identified as 10, provided with a carriage 18. The carriage 18 holds a series of ink jet print heads 20 (shown in phantom) configured for printing images on a variety of substrates. Typical substrates are textiles, as well as polyvinyl chloride (PVC) and reinforced vinyl. The printing system 10 is able to print on flexible as well as on non-flexible substrates, such as, for example, metals, glass, and plastics.

In some embodiments, the ink contains a solvent along with the pigment or dye. The solvent helps keep the ink in a liquid state as it is transported through the system and subsequently deposited on the substrate. The solvent then evaporates or is dried off after the ink has been applied to the substrate, resulting in a permanent image on the substrate. Alternatively, the ink can be UV curable. That is, the ink contains, in addition to a dye or a pigment, tiny bits of monomers when initially deposited onto the substrate that rapidly string themselves together via a chemical reaction when initiated, for example, by exposure to UV radiation. Thus, after being fully cured, the polymers act as a hardened glue for the embedded pigment to hold the pigment in place on the substrate. The operation and features of a printing system similar to the one shown in FIG. 1 is described in greater detail in U.S. patent application Ser. No. 09/834,999, filed Apr. 13, 2001, the entire contents of which are incorporated herein by reference.

In addition to the carriage 18, the printing system 10 includes a base 12, a transport belt 14 which moves a substrate positioned on top of the belt 14 through the printing system 10, and a rail system 16 attached to the base 12. The carriage 18 is attached to a belt 22 which is wrapped around a pair of pulleys positioned on either end of the rail system 16. A carriage motor is coupled to one of the pulleys and rotates the pulley during the printing process. Accordingly, as the transport belt 14 intermittently moves the substrate underneath the carriage 18, and hence the series of print heads 20, the pulleys translate the rotary motion of the motor to a liner motion of the belt 22 thereby causing the carriage 18 to traverse back and forth along the rail system 16 across the substrate 23 (FIG. 2) as the series of print heads 20 deposit ink onto the substrate.

The series of print heads 20 receives one or more colored inks from a set of secondary ink containers 26 which is also mounted in the carriage 18. In addition, a set of primary ink containers 28 supply the inks to the secondary ink containers 26. Unlike the secondary ink containers 26, the primary ink containers 28 are located remotely from the carriage 18, for example, within a section of the base 12 as shown in FIG. 1. Thus, the primary ink containers 28 remain stationary while the secondary ink containers 26 move with the carriage 18 during a printing operation. In some other embodiments, the carriage 18 is stationary while the substrate moves underneath the carriage.

Figure 2:
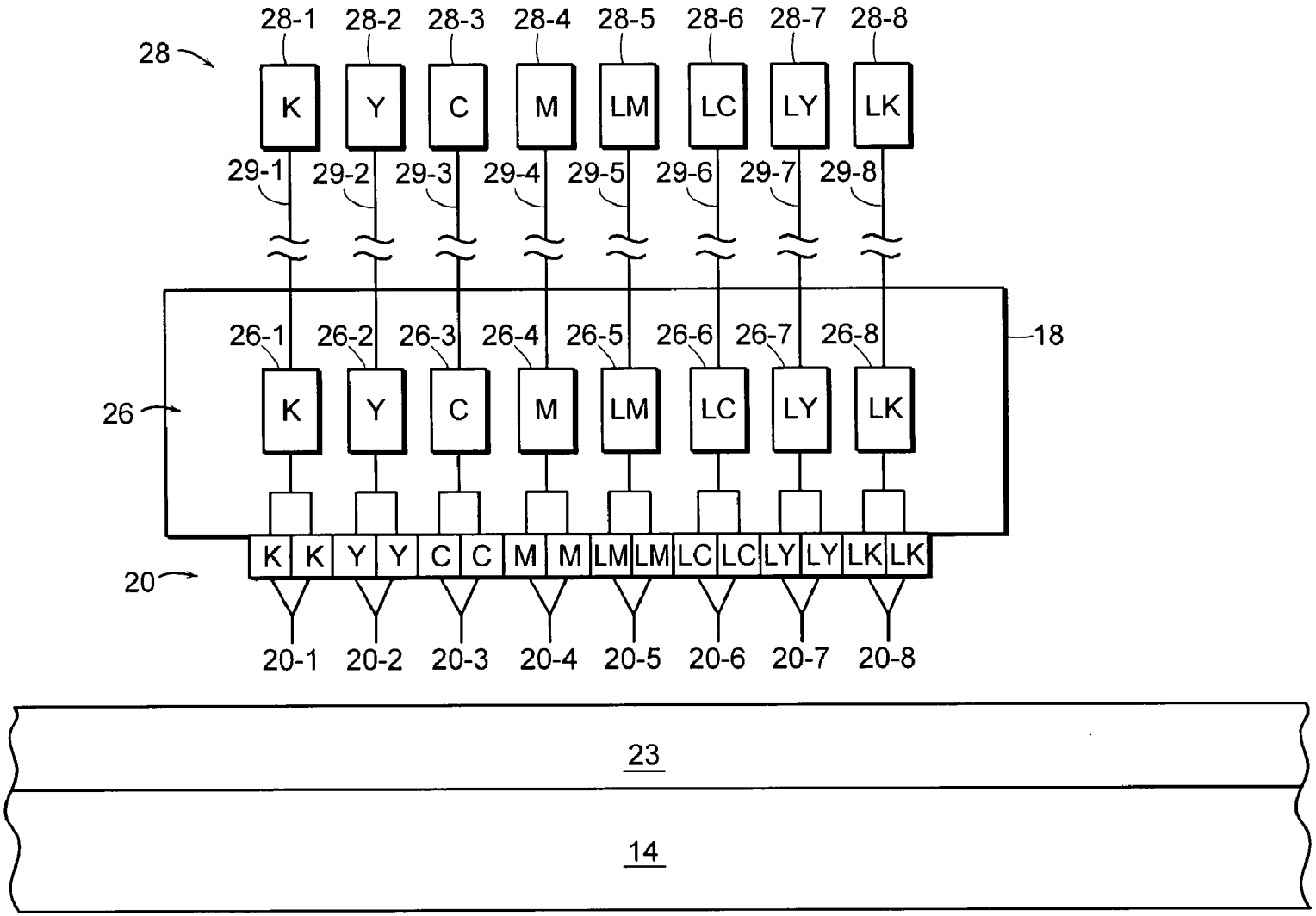
FIG. 2 is a schematic view of a carriage with printheads of the printing system of FIG. 1.

Referring now to FIG. 2, there is shown in more detail the arrangement of the series of print heads 20, the set of secondary ink containers 26, and the set of primary ink containers 28. The series of print heads 20 is actually eight pairs of print heads 20-1, 20-2, 20-3, 20-4, 20-5, 20-6, 20-7, and 20-8, with each pair associated with one of the colored inks black (K), light black (LK), yellow (Y), light yellow (LY), cyan (C), light cyan (LC), magenta (M), and light magenta (LM). Accordingly, various colors of a particular image are created on the substrate 23 by combining these colored inks. The primary ink containers 28-1, 28-2, 28-3, 28-4, 28-5, 28-6, 28-7, or 28-8 provide the various inks through, for example, tubes 29-1, 29-2, 29-3, 29-4, 29-5, 29-6, 29-7, or 29-8 to respective secondary ink containers 26-1, 26-2, 26-3, 26-4, 26-5, 26-6, 26-7, or 26-8 which in turn supplies the inks to a respective pair of print heads 20-1, 20-2, 20-3, 20-4, 20-5, 20-6, 20-7, or 20-8. For the embodiment illustrated in FIG. 2, the print heads 20-1, 20-2, 20-3, 20-4, 20-5, 20-6, 20-7, and 20-8 are associated with the colored inks K, Y, C, M, LM, LC, LY, and LK, respectively. Typically there are a set of tubes, filters and pumps through which the inks are transported from the primary ink containers 28 to the secondary ink containers 26. Note that the present invention is not limited to the arrangement shown in FIG. 2. The print heads can be associated with any colored ink. There can be fewer than or more than 16 print heads. A primary ink container and a secondary ink container can supply a respective ink to only one printhead or more than two print heads.

Figure 3:
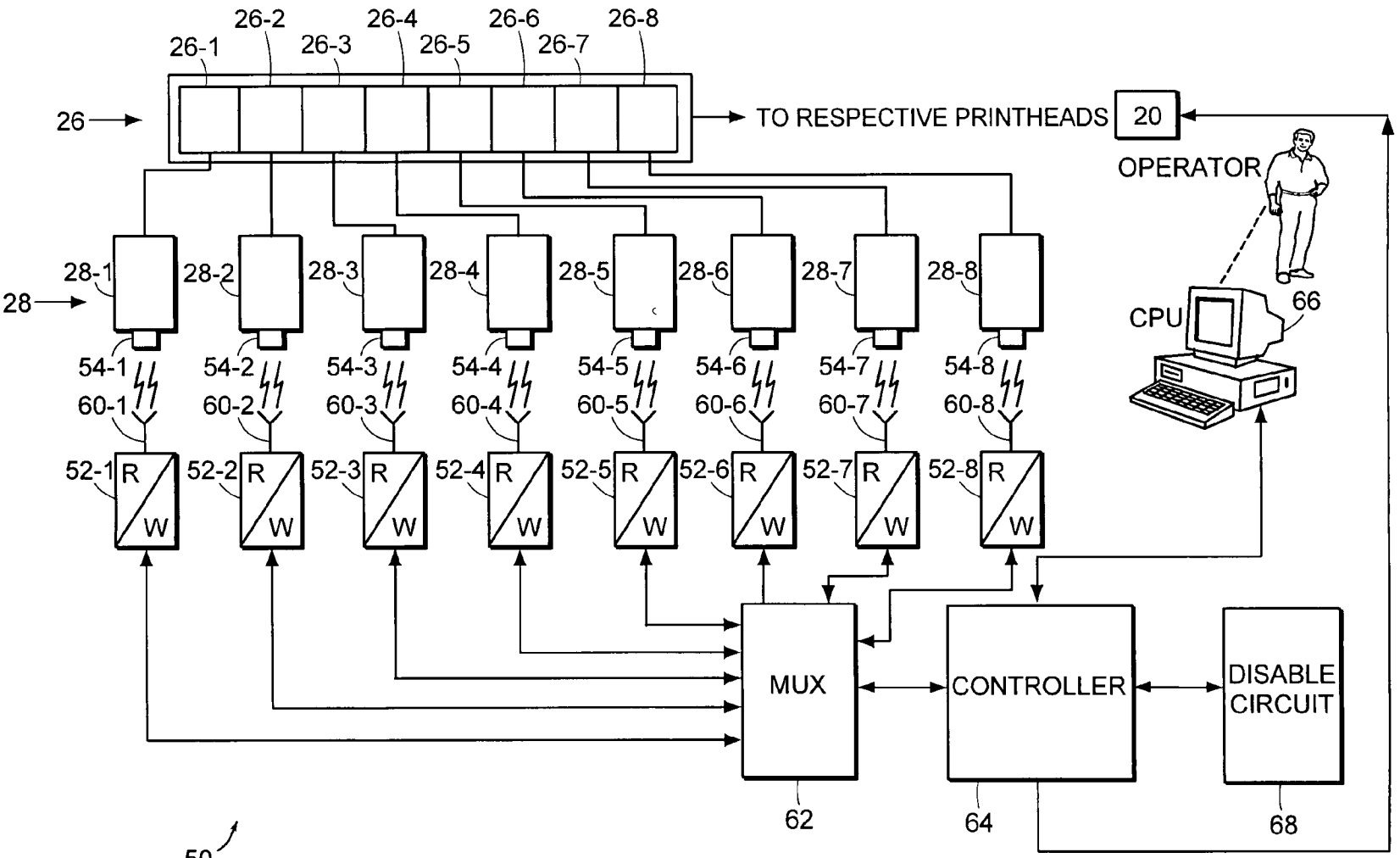
FIG. 3 is a schematic view of a radio frequency identification (RFID) system for the printing system of FIG. 1 to identify characteristics of the ink in accordance with the invention.
Figure 4:
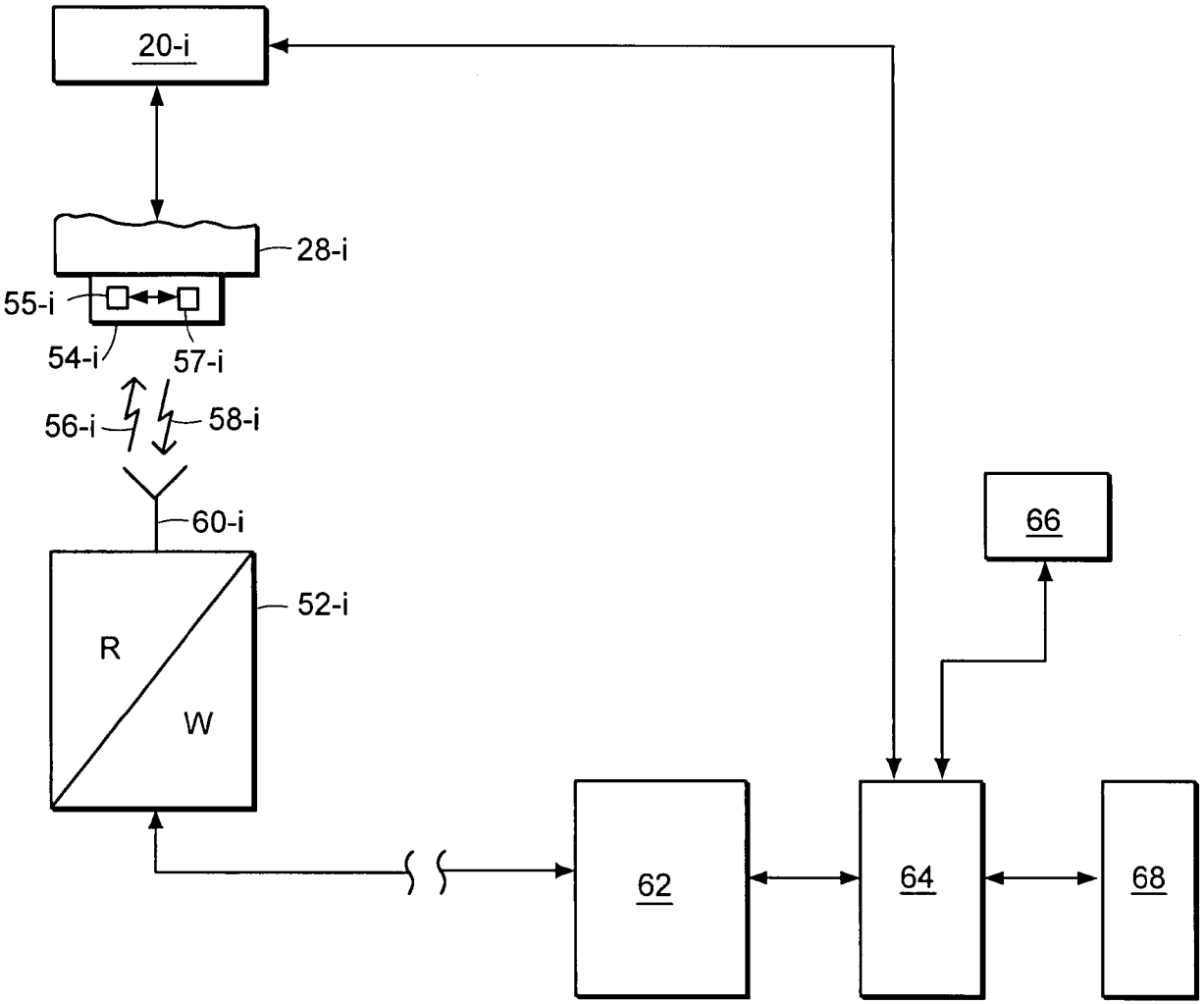
FIG. 4 is a block diagram of a tag and a reader/writer of the RFID system of FIG. 3.

Referring now to FIGS. 3 and 4, there is shown a radio frequency identification (RFID) system 50 for identifying various characteristics of the inks held in the primary containers 28-*i*, where i=1, 2, 3, . . . , n identifies the particular container, and hence the printhead, and n stands for the nth container, which may, for example, be eight in this case. For example, in certain applications, the RFID system 50 identifies the color, as well as the expiration date of each ink contained in each of the primary containers 28-*i*. The RFID system 50 includes a reader/writer 52-*i* and a tag 54-*i* associated with each of the primary containers 28-*i*. As previously noted, the tags 54-*i* are also known as transponders and labels.

In the illustrated embodiment, each tag 54-*i* may generate a 125 KHz RF signal derived from a 256 bit eprom chip that holds up 32 ASCII digits of data, although in certain applications, direct HEX data may be stored in and retrieved from a logic and memory circuit 55-*i* of the tag 54-*i* to facilitate encrypting the data. The signals to and from the tag 54-*i* are transmitted in the form of RF energy through a transmitter/receiver 57-*i* that couples the information to the logic and memory circuit 55-*i* or obtains the stored data from the logic and memory circuit 55-*i*.

The reader/writer 52-*i* which operates at 125 KHz in an asynchronous full duplex mode as either a DTE or DCE device may include either an 8, 16, or 32 character version. Some embodiments may have a single microprocessor with selection derived through hardware on the PCB. The default communications protocol on the reader/writer 52-*i* is 9600 baud, 8 bits, No parity, 1 stop bit. Different baud rates can be selected via shunts located on the PCB. Other details and operation of the reader/writer 52-*i* and tag 54-*i* can be found in the "Installation and Operating Manual for Model SR1 and SR2," by RFID, Inc., 2000, the entire contents of which are incorporated herein by reference.

As shown, the reader/writer 52-*i* transmits write signals 56-*i* to and receives read signals 58-*i* from the tag 54-*i* through the use of an antenna 60-*i*. The antenna 60-*i* can be fully integrated with the reader/writer 52-*i*. That is, the reader/writer can be a single reader/writer box design. Alternatively, the reader/writer can be externally coupled to the antenna 60-*i*.

In the receive direction 56-*i*, the reader/writer 52-*i* or alternatively some other writer writes to the tag 54-*i*. That is, the tag 54-*i* is programmed with the desired information such as the origination date and color of the ink, as well as the appropriate location of the container 28-*i* in the system 10.

Once the container 28-*i* has been placed in the system 10, the tag 54-*i* and the reader/writer 52-*i* typically operate in the transmit direction 58-*i*. As such, the reader/writer 52-*i* reads data from the tag 54-*i* to determine if the ink at a particular location is the correct colored ink, and to determine if the ink has not be used beyond its expiration date.

As mentioned above, information is programmed into the tags' 54-*i* memory 55-*i* using the reader/writers 52-*i*, or alternatively another reader/writer, and periodically the reader/writers 52-*i* receive data from the tags 54-*i*. The reader/writers 52-*i* are connected to a multiplexor 62 so that information received by each reader/writer 52-*i* is periodically sent to a controller 64, for example, when requested by an operator interfacing with a CPU or computer 66. The operator may request information for a particular container 28-*i*, or may request information for all the containers. Alternatively, the controller can be programmed to obtain information about the containers at particular time intervals, so that the interrogation process may be fully automated.

If an incorrect color is read by a respective reader/writer 52-*i*, the information is transmitted to the controller 64 which then instructs a disabler circuit 68 to terminate operation of the printing system 10. Similarly, if the lifespan of the ink has been exceeded, that information is also communicated to the controller 64 which in turn ceases operation of the printing system through the disabler circuit 68.

To operate the RFID system 50, the reader/writer 52-1 is interfaced to the computer 66 through the controller 64. Any program can be used to capture reads to the screen of the computer terminal 66. The program can be Windows based, or a DOS-based program such as Procomm. The terminal program is set to the default communications protocol settings of the reader/writer 52 (e.g., 9600 baud, 8 bits, No parity, 1 stop bit [9600, 8, N, 1]). The protocol settings of the reader/writer 52-*i* can be changed, although the terminal program protocols must also be altered to the different set of protocol settings. Furthermore, the program is typically set to operate at Full Duplex.

As mentioned previously, the tags 54-*i* can be preprogrammed with the desired information, or they can be programmed with the reader/writers 52-*i*. That is, an operator through the use of the computer 66 can instruct the reader/writers 52-*i* to transmit the information to the tags 54-*i* which stores the information in its memory 55-*i*.

There are two modes or ways, as selected by the operator, the reader/writer 52-*i* reads data from the tags 54-*i*. In the first mode, the reader/writer 52-*i* is set to report the tag data in an ASCII string once immediately upon detecting the tag 54-*i*. There is a time out of about 2.5 seconds that occurs when the tag 54-*i* is read, and it cannot be re-read until the time out expires. This does not imply that the same tag 54-*i* will be re-read exactly every 2.5 seconds, rather, it will be re-read after the timeout expires, and the microprocessor has demodulated the tag's bit sequence. The time between the read and re-read is influenced by ambient conditions and environments, for example, those having varying degrees of EMI. In other embodiments, there is no timeout, and thus the same tag is never reported twice.

In the second read mode, the reader/writer 52-*i* reports the tag data in an ASCII string repeatedly, immediately upon detecting the tag 54-*i*. This continues as long as the reader/writer 52-*i* detects the tag 54-*i*; that is, the tag 54-*i* is present in the reader/writer's field.

In sum, data about each container 28-*i* is encoded on the memory 55-*i* associated with a respective container 28-*i*. This data may be modified by the reader/writer 52-*i* by sending an RF signal from the controller 64 via the MUX 62 and the antenna 60-*i*. The modulated signal from the antenna 60-*i* is received by the transceiver 57-*i* which demodulates the signal and sends the modified data to the memory 55-*i*.

The information stored in the memory 55-*i* of the tag 54-*i* can be interrogated from the controller 64 by sending a digitized request via the MUX 62 and the antenna 60-*i*. Again the modulated signal from the antenna 60-*i* is received by the transceiver 57-*i* which demodulates the request signal and couples it to the memory 55-*i*. A reply signal from the memory 55-*i* transmits the requested data back over the return path from the transceiver 57-*i* to the antenna 60-*i* of the reader/writer 52-*i*, the MUX 62, and hence to the controller 64 for display in the CPU 66.

Figure 5:
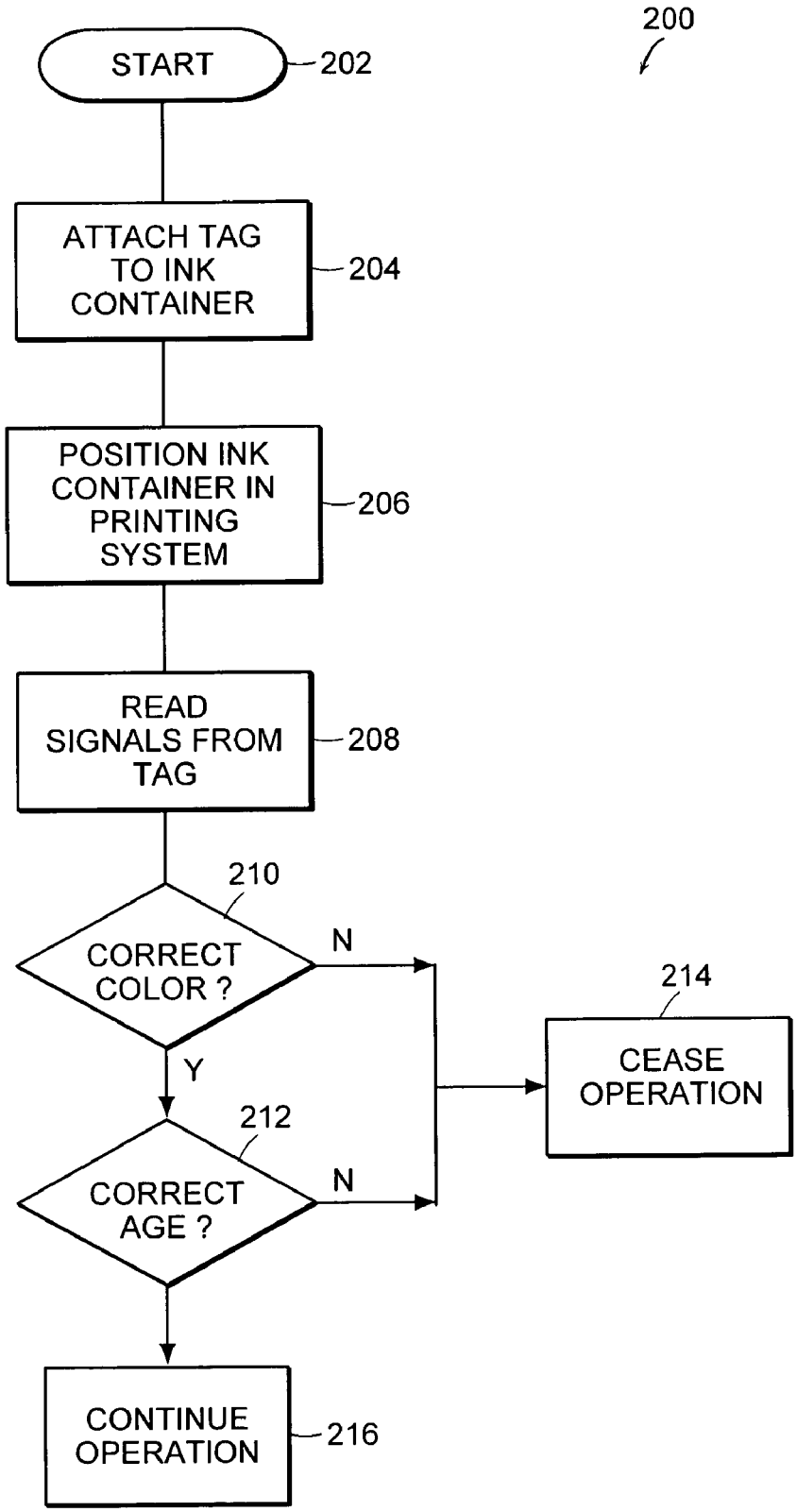
FIG. 5 a flow diagram of a sequence of steps to operate the RFID system of FIG. 3 in accordance with the invention.

Referring now to FIG. 5, there is shown a process 200 to operate the RFID system 50. The process 200 starts in step 202. In step 204, the tag 54-*i* is attached to respective ink container, identifying the color of the ink and the date the ink was produced. As mentioned before, the tag can be preprogrammed with such information, or the reader/writer 52-*i* can be used to program the tag 54-*i*. Next, in step 206, the container is positioned in its appropriate location in the system 10. The location of the container can also be preprogrammed, or the reader/writer 52-*i* can be used.

In step 208, once the system 10 is operating, the controller 64 as programmed for example by the user, periodically instructs the reader/writer 52-*i* to read signals transmitted from the tags 54-*i*, or the user can request the reader/writer 52-*i* to read the desired information at any time. Thus, the controller identifies the location of the container, and then determines if the correct color is identified with that particular location in step 210. Then, the controller 64 reads the date of origination of the ink, and determines whether or not the date has exceeded the expiration date in step 212. In step 214, if either the color is incorrect or if the age of the ink has exceeded its expiration date, the controller activates the disabler circuit 68 to terminate the operation of the printing system 10. The user must then replace the one or more ink containers that has been identified by the controller as having the incorrect color or exceeded its expiration date or both. If however, the inks are the correct color and have not exceeded their respective expiration date, operation of the system 10 continues (step 216).

It will be apparent to those of ordinary skill in the art that methods disclosed herein may be embodied in a computer program product that includes a computer usable medium. For example, such a computer usable medium can include a readable memory device, such as a hard drive device, a CD-ROM, a DVD-ROM, or a computer diskette, having computer readable program code segments stored thereon. The computer readable medium can also include a communications or transmission medium, such as a bus or a communications link, either optical, wired, or wireless, having program code segments carried thereon as digital or analog data signals.

While this invention has been particularly shown and described with references to preferred embodiments thereof, it will be understood by those skilled in the art that various changes in form and details may be made therein without departing from the scope of the invention encompassed by the appended claims. For example, while the invention has been described, for convenience, as an RF transceiver device, it is contemplated that acoustic or sonic transceivers may be substituted by those skilled in the art.

What is claimed is:

1. A printing system comprising:

a plurality of ink containers, each ink container adapted to be installed in the printing system and comprising an ink and an associated tag, each tag comprising rewritable data that identifies a manufacturing date of the associated ink, each ink comprising an expiration date;

a reader/writer adapted to read data from an identified tag and to write the manufacturing date of the associated ink to the identified tag; and a controller coupled to the reader/writer, the controller adapted to allow a user to instruct the reader/writer to write the manufacturing date of the associated ink to the identified tag while the ink container is installed in the printing system, and to determine if the expiration date of the ink associated with the identified tag has been exceeded.

2. The printing system of claim 1, wherein:

each tag comprises a memory with logic which stores the manufacturing date data of the associated ink, and a source which generates a signal relating to the data; and wherein the reader/writer is adapted to read the signal from the identified tag.

3. The system of claim 2, wherein the signal comprises a radio frequency signal.

4. The system of claim 2, wherein the memory also stores data that identifies the color of the associated ink.

5. The printing system of claim 2, wherein the signal from the identified tag is transmitted to the reader/writer wirelessly.

6. The printing system of claim 1, further comprising a disabler circuit coupled to the controller, the disabler circuit adapted to disable the printing system if the expiration date of the ink associated with the identified tag has been exceeded.

7. The printing system of claim 1, wherein each tag is attached to the associated container.

8. The printing system of claim 1, wherein each of the tags comprise radio frequency (RF) identification tags.

9. A method for use with a printing system that comprises a plurality of ink containers, each ink container comprising an ink that comprises an expiration date, the method comprising:

providing a plurality of tags;

uniquely associating each tag with a corresponding one of the containers, each tag comprising rewritable data that identifies a manufacturing date of the associated ink;

installing the plurality of ink containers in the printing system;

providing a controller that allows a user to instruct a reader/writer to read data from an identified tag and to write the manufacturing date of the associated ink to the identified tag while the ink container is installed in the printing system; and determining if the expiration date of the ink associated with the identified tag has been exceeded.

10. The method of claim 9, further comprising using the reader/writer to wirelessly read the data from the identified tag.

11. The method of claim 9, wherein the data from the identified tag is read via a radio frequency (RF) signal.

12. The method of claim 9, further comprising disabling the printing system if the expiration date of the ink associated with the identified tag has been exceeded.

* * * * *